US005547101A

United States Patent [19]

Haquin et al.

[11] Patent Number: 5,547,101

[45] Date of Patent: Aug. 20, 1996

[54] ACID TANK CLOSING DEVICE

[75] Inventors: Michel Haquin, Villiers Sur Marne; Jacques Brosson, Riom, both of France

[73] Assignee: CLECIM, Cergy Pontoise, France

[21] Appl. No.: 39,096

[22] PCT Filed: Aug. 6, 1992

[86] PCT No.: PCT/FR92/00777

§ 371 Date: Apr. 9, 1993

§ 102(e) Date: Apr. 9, 1993

[87] PCT Pub. No.: WO93/03200

PCT Pub. Date: Feb. 18, 1993

[30] Foreign Application Priority Data

Aug. 9, 1991 [FR] France ..... 91 10194

[51] Int. Cl.[6] ..... B65D 6/28

[52] U.S. Cl. ..... 220/561; 220/217; 220/228; 220/430; 220/565

[58] Field of Search ..... 220/217, 228, 220/430, 431, 432, 433, 561, 565; 156/345; 134/122 R, 201; 52/11, 94, 95, 96, 169.11, 169.14, 169.7, 244, 246, 249, 265, 266, 267, 268, 269, 274, 284, 300, 595, 612

[56] References Cited

U.S. PATENT DOCUMENTS

| | | | |
|---|---|---|---|
| 1,046,910 | 12/1912 | Wagner | 52/11 X |
| 1,360,170 | 11/1920 | Allinson | 220/228 X |
| 1,963,405 | 6/1934 | Eichelman et al. | 72/13 |
| 2,991,905 | 7/1961 | Monson et al. | 220/228 |
| 3,267,685 | 8/1966 | Schroeder | 220/228 X |
| 3,473,791 | 10/1969 | White et al. | 261/124 |
| 3,803,996 | 4/1974 | Marshall | 98/115 R |
| 4,604,157 | 8/1986 | Damiron et al. | 156/345 |

FOREIGN PATENT DOCUMENTS

| | | | |
|---|---|---|---|
| 286572 | 6/1931 | Austria | 52/259 |
| 1006748 | 4/1952 | France | 52/179 |

*Primary Examiner*—Stephen K. Cronin

*Attorney, Agent, or Firm*—Pollock, Vande Sande & Priddy

[57] ABSTRACT

A water seal device for closing a tank containing a corrosive product, such as acid, closed by a cover having a side lip which is able to engage, on closing, in a U-shaped channel provided along the upper edge of the side wall. The channel is made up of monolithic shaped elements, each made from a natural rock of eruptive origin of the lava type, and arranged in sequence on the upper edge of the side wall. The invention applies particularly to installations for chemically pickling sheet metal.

8 Claims, 1 Drawing Sheet

ACID TANK CLOSING DEVICE

FIELD OF THE INVENTION

This invention relates to a closing device for a tank containing a corrosive product, particularly an acid pickling tank for a product in strip form such as a sheet metal.

The invention also relates to a process for repairing the seal of an existing tank.

BACKGROUND OF THE INVENTION

The metal strips produced in a rolling mill are normally pickled, particularly after hot rolling and before cold rolling, to remove the oxide coating formed on their surface during the hot rolling process, along with any other deposits or stains that might become encrusted in the sheet metal during cold rolling.

Generally, metal sheets are pickled in tanks containing a hot sulfuric or hydrochloric acid solution through which the sheet metal is passed while immersed in the acid solution. A pickling tank is therefore generally very long, for example, twenty to thirty meters, its width, which remains constant along its whole length, being chosen according to the maximum width of the strips to be treated.

A pickling tank therefore generally comprises a vat made up of a rectangular bottom considerably longer than it is wide, surrounded by a vertical side wall comprising two longitudinal sides and two transversal sides.

The pickling installation generally comprises at least two successive tanks and is located in a large building. Since the vapors released by the acid are liable to corrode any material located above or around the tanks, the pickling tanks are generally located on an upper level of the building, while the other equipment such as the strip collecting means are located on the lower level. For this reason, concrete vats are too heavy to be used, and, in order to provide the required strength without excessive weight, the pickling vat is generally delimited by a wall comprising an external shell made of sheet metal which provides the mechanical strength required, and which is internally lined with a covering that both prevents the acid solution from coming into contact with the metal wall and thermally insulates the wall from the acid solution, which is maintained at a relatively high temperature. The sheet metal is usually lined with a rubber layer which is in turn covered by brickwork comprising at least one layer of aluminosilicate bricks which provides good resistance to acid and satisfactory thermal insulation and which also resists wear caused by occasional or regular rubbing of the steel strip as it passes through the tank.

The vapors relased at the surface of the acid bath are extremely corrosive and can be captured by hoods and directed to the depollution installations. The release of vapors must nevertheless be minimized as much as possible. For this purpose, the tank is closed by a cover which provides as effective a seal as possible on the upper edge of the side wall.

To provide a satisfactory seal between the cover and side wall, a device designated as a "water seal" is generally used. It consists of an upwardly open U-shaped channel filled with water which is fitted along the upper edge of the side wall, and into which penetrates a lip provided on the periphery of the cover.

To date, this channel has also been made of metal and is welded to the upper edge of the sheet metal forming the outer portion of the side wall. While not directly in contact with the acid bath, it must obviously be protected against the corrosive action of the vapors, and is therefore covered with a vulcanized or ebonited rubber covering.

While such an arrangement is theoretically satisfactory, it nevertheless wears fairly rapidly because the rubber covering the channel is subject to considerable shocks which occur when the covers are placed in position, and which, over time, cause the acid-resistant covering to split or even break up. The metal structure is then rapidly attacked and, given the relative ineffectiveness of partial repairs, the upper portion of the tank will need to be completely rebuilt after a few years.

This involves first dismantling the upper part of the brickwork, removing the old channel by cutting the outer shell, and welding on a new rubberized channel.

The welding operation does, of course, damage the rubber lining, which must be removed along a certain length each side of the weld, which in turn requires the removal of bricks. Once the channel has been fitted and welded, the continuity of the rubberizing on the weld must be reestablished and the brickwork rebuilt. This type of repair work takes a very long time, possibly from ten to twenty days depending, for example, on the state the metal sheet is found to be in after the bricks are removed. The installation must be shut down for the entire repair period, leading to a substantial loss of production. Moreover, this kind of seal replacement work must be carried out at regular intervals. To afford better protection for the channel, the use of brickwork has been suggested, but its thickness is limited to approximately 20 mm and it is therefore very fragile. Acid can also seep into the seals.

SUMMARY OF THE INVENTION

The intended invention is to overcome this problem by substantially improving the lifetime of the seals. It has the advantage of being applicable to existing tanks since the new seal in accordance with the invention can advantageously replace the old seal once it has become worn or damaged.

The object of the invention is a closing device which is applicable, in a general way, to a tank containing a corrosive product, said tank comprising a bottom surrounded by a side wall whose upper edge delimits an opening which is closed by a cover having a side lip designed to engage, on closing, in a U-shaped channel provided along the upper edge of the side wall.

In accordance with the invention, the channel is made up of monolithic shaped elements made from natural rock of eruptive origin of the lava kind, arranged in sequence on the upper edge of the side wall.

In certain formerly volcanic regions, eruptive rocks are available in large quantities, particularly lava rock, which can be machined into pieces of various shapes and at the same time retains good resistance to abrasion. The composition of some lava also confers excellent resistance to acids, even to hot acids. This is the case, in particular, for lava from the Volvic region in France, which has a $SiO_2$ and $Al_2O_3$ content of above 60%, a porosity of between 6 and 30% and a specific gravity of less than 3.

Such lava occur in the form of thick layers and are easy to machine. This means that monolithic elements of relatively large dimensions can be carved from the block, and by machining can be given a U-shape, the dimensions of which are such that, in accordance with a preferred embodiment of the invention, the channel elements thus produced can cover the assembly formed by the sheet metal and protective lining forming the side wall of the tank.

In accordance with a further particularly advantageous embodiment, the lower face of each channel element is provided with a slot for centering such element relative to the upper edge of the side wall. The width of this slot can also be limited to that of the outer sheet metal shell so as to engage on its upper edge.

The centering slot can also be placed at a certain distance from the outer edge of the channel so that a portion of it projects outwardly from the side wall.

In accordance with a further preferred embodiment, each channel element is made up of two parts of U-shaped cross-section, respectively one inner part and one outer part, one fitting inside the other, with a protective layer made of rubber, for example, being advantageously arranged between them.

The invention also relates to a process for repairing a water seal provided on the surround of the upper opening of an acid tank, and which is made up of a channel in which a lip on the cover can engage. In accordance with the invention, the whole of the channel is removed, the upper edge of the side wall assembly made up of an outer sheet metal shell and brickwork is then leveled to a substantially horizontal level and, the assembly is then being covered by a new channel formed of elements placed end to end, each comprising a block carved from lava type eruptive rock, provided by machining with a U-shaped cross-section of the desired dimensions.

BRIEF DESCRIPTION OF THE DRAWINGS

The invention will be better understood from the following description of a particular embodiment which is purely illustrative and is to be read in conjunction with the accompanying drawings in which.

DETAILED DESCRIPTION

Figure 1:
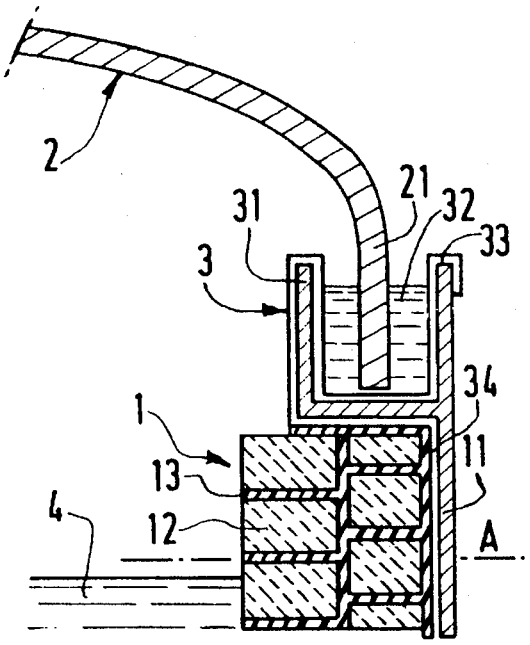
PRIOR ART FIG.1
FIG. 1 shows a partial, cross-sectional view of a water seal according to the prior art, placed along the edge of an acid tank.

FIG. 1 schematically shows the upper portion of the side wall 1 of a vat containing acid closed by a cover 2. Side wall 1 is made up of an outer sheet metal shell 11 which is internally lined with brickwork 12 made up of regularly juxtaposed bricks bound together by acid-resistant cement or resin seals 13.

Sealing between the cover 2 and side wall 1 is achieved by a water seal 3 made up of a channel 31 containing water 32 and in which engages a side lip 21 of cover 2.

In accordance with the conventional constructional method used to date, channel 31 is made of sheet metal and is fixed on to the upper edge of metal shell 11.

Channel 3 is in contact with acid vapors released above bath 4 inside the tank, which meads that water 32 contained in the channel must have a certain acidity. For this reason, channel 31 is covered with an acid-resistant covering 33 which surrounds the whole channel, continuing at 34 between metal shell 11 and brickwork 12 so as to protect shell 11 from acid infiltration, such acid infiltration being inevitable even if seals 13 are perfectly produced.

Protective layer 33 must be continuous and is generally made of vulcanized rubber or ebonite.

As discussed above, it is inevitable that side lip 21 will strike channel 3 relatively hard when cover 2 is being handled. The protective covering 33 of channel 3 is therefore liable to become damaged in same places and may as a result allow acid to seep through to sheet 31. Metal sheet 31 therefore becomes corroded, allowing acid to reach outer shell 11.

Once the seal has become corroded beyond a certain point, it becomes necessary to replace it entirely. The tank must therefore be drained and channel 3 removed, together, depending on the case, with the upper portion of the side wall.

Since the new channel has to be welded on to side wall 11, protective layer 3 must also be stripped back to a certain distance from where the weld is to be made. Brickwork 12, even if sound, must also be removed as far as level A. A new channel prepared beforehand and covered with ebonite is welded on to the remaining portion of shell 11. The continuity of the protective lining 34 around the weld must then be reestablished and the upper portion of brickwork 12, removed earlier, must be replaced. As discussed earlier, all these operations are very time consuming.

Figure 2:
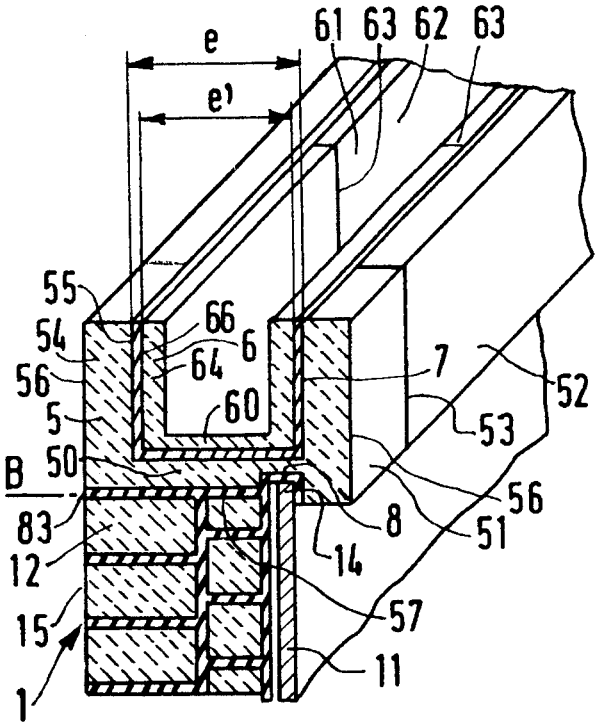
FIG. 2 shows a cross-sectional view of the water seal in accordance with the invention.
Figure 3:
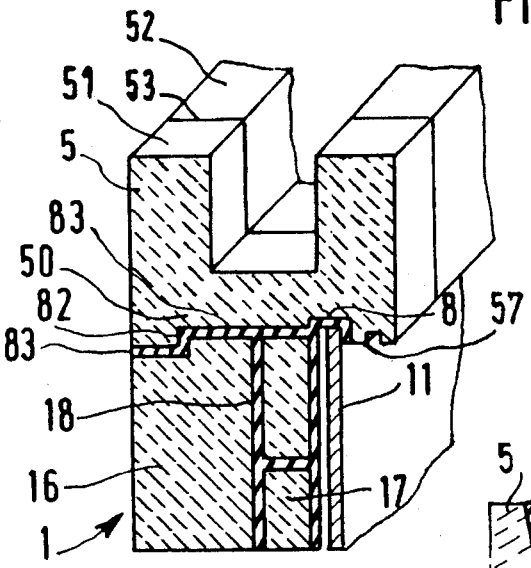
FIG. 3 shows a second embodiment of the water seal.
Figure 4:
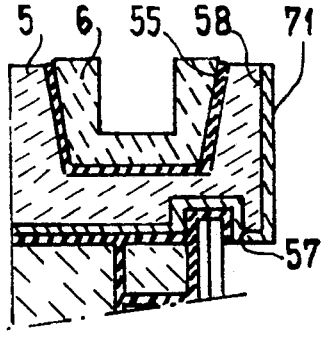
FIG. 4 shows a variant including a sealing insulating layer.

The new seal in accordance with the invention, a number of embodiments of which are shown in FIGS. 2, 3 and 4, makes it possible to considerably simplify these operations.

In the simplest embodiment, which is shown in FIG. 3, the seal is made up of solid elements 5 of U-shaped cross-section, carved from an eruptive rock, preferably Volvic lava, which exhibits special qualities for this kind of application. The channel is made up of monolithic elements 51, 52 placed in sequence along the upper edge of wall 1. The special qualities of the lava make it possible to produce extremely long elements, two meters long, for example. Consequently, the number of seals 53 between two adjoining elements 51, 52 is much smaller compared to a brick lining and the risk of leakage is reduced significantly. In the embodiment shown in FIG. 3, channel 5 comprises, viewed transversally, a single element carved in the shape of a U over a sufficient thickness to resist cracking, and a protective layer 83, provided on the lower face 57 of channel 5 to oppose acid infiltrations should cracks form along the length of the element as a result of repeated shocks.

To further reduce the risk of leakage, the channel can advantageously be made up of two U-shaped elements 5, 6 which engage inside each other in the manner shown in FIG. 2.

Each element 5 (6) comprises a bottom 50 (60) and two side arms 54 (64), the distance e between the inner faces 55 of arms 54 of outer element 5 being greater than distance e' between the outer faces 66 of arms 64 of inner element 6 which can thus be incorporated in outer element 5, a protective layer 7 in resin or acid-resistant cement being interposed between the opposing faces 55, 66 of the two channel elements 5, 6.

Like outer channel 5, inner channel 6 is made up of elements 61, 62 placed in sequence. To further reduce the risk of infiltration, seals 63 between two adjoining elements 61, 62 are offset relative to seals 53 between two elements 51, 52 of outer channel 5.

The width of the assembly must be greater than the width of side wall 1 so that the upper part of side wall 1 is completely covered by channel 5.

In accordance with an even more perfected embodiment as shown in FIG. 4, it can also be advantageous to give a certain slope to the inner faces 55 of outer channel 5 so that they slightly diverge in an upwardly direction, the outer faces 66 of lower channel 6 having the opposite inclination.

Such an arrangement facilitates the fitting of inner channel 6 and the realization of intermediary layer 7.

To repair a damaged channel, such as the type shown in FIG. 1, the channel is removed and any necessary repairs are carried out on the upper part of wall 1. If wall 1 has not been attacked, it can retain its original height. The use of a lava channel makes it possible to avoid welding and, as a result, to level the upper edge of the whole of wall 1 to a substantially horizontal level d. Since no welding is required, protective layer 3 does not risk damage.

Preferably, upper edge 14 of outer metal shell 11 of the vat is leveled to a level slightly higher than level B of the brickwork 12 so that it engages in slot 8 provided on lower face 57 of channel 5 which simply rests on the upper face of brickwork 12, this being covered with a protective layer 83.

Advantageously, the width of channel 5 can be substantially larger than that of wall 1 so that slot 8 is offset relative to the outer face of channel 5, whereas face 56 facing the inside of the tank is aligned with the inner face 15 of the brickwork. This offsetting of the outer face of channel 5 makes it possible to distance metal wall 11 from any acidified water droplets that might overflow from the channel.

Given the relative ease with which lava can be machined, lower face 57 of channel 5 can be provided with a slot forming a drip track to prevent acid from trickling down the side wall.

Use of a lava channel considerably simplifies repair operations and reduces the time taken to remake the seal because of the smaller number of parts to be put in position. In fact, a normal-size tank can be repaired in four days, instead of the customary ten to twenty days.

Lava rock has much better shock resistance than the rubber covering used previously to protect the metal channels, and for this reason the single-layer channel shown in FIG. 3 is able to provide sufficient safety. However, the double-layer 5, 6 channel design makes it possible to enhance resistance and increase the lifetime of the seal. Indeed, if inner channel 6 is accidentally cracked by shocks, the resulting infiltration will be stopped by protective layer 7 which also tends to act as a damper, such that the risk of cracking of outer channel 5 is very small.

In addition, because the elements are very long, only a small number of seals is required and a much smaller quantity of rubber or resin is used in producing the seals.

Moreover, as shown in FIG. 4, additional safety can be provided by covering inner face 57 and outer side face 58 of channel 5 with a sealing insulation layer 71.

Although the invention has been described in relation to the repair of existing tanks, the use of lava channels is even more advantageous for the realization of the water seal for new installations.

It is also possible to realize the whole inner protective lining in lava, as shown in FIG. 3.

Indeed, in the example shown in FIG. 3, the outer sheel metal shell 11 is covered with one or two layers of lava plates 16, 17 between which a rubber protective layer 18 is placed to prevent infiltration.

Using lava plates or slabs considerably reduces the length of seals 18 and therefore both the manufacturing cost and the risk of infiltration.

Since lava is relatively easy to machine, a step shape can also be provided on the upper edge of slabs 16, into which a corresponding shape 82 provided on the inner face 50 of channel 5 can engage, a protective layer 83 being interposed between them. Such a step shape, along with slot 8, serves to center and hold channel 5 on the upper edge of side wall 1.

It is clear that other embodiments are possible, one of the main advantages of lava being the ease with which it can be machined plus its properties of mechanical strength and resistance to acid corrosion.

Furthermore, in a general way, the invention is not limited to the features of the embodiments described above. In particular, while a double-layer channel 5, 6 provides, as already mentioned, a longer lifetime, the use of a single-layer channel would suffice for simpler embodiments.

What is claimed is:

1. A closing device and tank for containing a corrosive product, said tank comprising a bottom surrounded by a side wall having an upper edge delimiting an opening which is closed by a cover fitted with a side lip designed to engage on closing, in a seal, said seal having a U-shaped channel provided along said upper edge of the side wall and containing water, said U-shaped channel being made up of a plurality of monolithic U-shaped elements arranged in sequence on the upper edge of the side wall, each monolithic element being carved from natural igneous eruptive rock, and seals being provided between adjoining monolithic U-shaped elements.

2. The closing device as claimed in claim 1, wherein each U-shaped channel has a lower face provided with a slot for centering said channel relative to said upper edge of said side wall.

3. The closing device as claimed in claim 2, wherein said slot is placed at a certain distance from an outer side face of said channel, such that a portion of said U-shaped channel projects outwardly from said side wall.

4. The closing device as claimed in claim 1, wherein said side wall of said tank is made up of a metal shell internally covered by a protective lining, said channel having an outer width at least equal to a width of the whole of said side wall so as to cover said side wall.

5. The closing device as claimed in claim 1, wherein said U-shaped channel has a lower face and an outer side face covered with an insulating, sealing layer.

6. A closing device and tank for containing a corrosive product, said tank comprising a bottom surrounded by a side wall having an upper edge delimiting an opening which is closed by a cover fitted with a side lip designed to engage on closing, in a seal, said seal having a U-shaped channel provided along said upper edge of the side wall, and containing water, wherein said U-shaped channel is made up of a plurality of monolithic U-shaped elements arranged in sequence along the upper edge of said side wall, each monolithic element being carved from natural igneous eruptive rock, seals being arranged between adjoining monolithic U-shaped elements, and wherein said channel comprises two parts, outer part and an inner part fitted inside said outer part, each of said parts being made of said monolithic U-shaped elements placed in sequence, wherein the seal between adjacent monolithic U-shaped elements of said outer part are offset longitudinally relative to the seal between adjacent monolithic U-shaped elements of said inner part.

7. The closing device as claimed in claim 6, wherein each element made up of said two parts of said channel comprises a bottom and two side arms, a distance between inner faces of said side arms of said outer element being greater than a distance between outer faces of said side arms of said inner element, and wherein a protective layer is provided between said side arms and said bottom of said inner and outer elements.

8. The closing device as claimed in claim 7, wherein said inner faces of said side arms of said outer element are inclined at a certain angle relative to the vertical so as to form an upwardly open dihedral, and wherein said outer faces of said inner part are inclined by the same certain angle in an opposite direction so as to converge downwardly.

* * * * *